United States Patent [19]

Uga

[11] 4,377,740

[45] Mar. 22, 1983

[54] INITIALIZING CIRCUIT ARRANGEMENT FOR A COUNTER CIRCUIT

[75] Inventor: Kozo Uga, Kawasaki, Japan

[73] Assignees: Toyota Jidosha Kogyo Kabushiki Kaisha; Nippondenso Co., Ltd., both of Toyota; Jeco Co., Ltd., Kawasaki, all of Japan

[21] Appl. No.: 161,685

[22] Filed: Jun. 23, 1980

[30] Foreign Application Priority Data

Jun. 25, 1979 [JP] Japan ..... 54-87221

[51] Int. Cl.[3] ..... G04B 27/00

[52] U.S. Cl. ..... 377/2; 368/187; 377/44

[58] Field of Search ..... 235/92 T, 92 PE; 364/705; 368/187

[56] References Cited

U.S. PATENT DOCUMENTS

| | | | |
|---|---|---|---|
| 3,795,098 | 3/1974 | Fujita | 368/187 |
| 3,942,318 | 3/1976 | Fujita | 368/187 |
| 4,120,036 | 10/1978 | Maeda et al. | 364/705 |
| 4,201,041 | 5/1980 | Tanaka | 368/187 X |
| 4,300,204 | 11/1981 | Maeda et al. | 364/705 |
| 4,320,478 | 3/1982 | Daniels et al. | 368/187 X |

*Primary Examiner*—David H. Malzahn

*Attorney, Agent, or Firm*—Charles E. Pfund

[57] ABSTRACT

A plurality of counters are connected with a plurality of correction terminals for independently correcting counts of the counters. An initializing circuit is connected between initializing terminals of the counters and the correction terminals. An initializing signal generator is connected between an input line from the power source and the correction terminals, for initializing the counters to predetermined counts only when signals are simultaneously applied to the correction terminals.

7 Claims, 6 Drawing Figures

INITIALIZING CIRCUIT ARRANGEMENT FOR A COUNTER CIRCUIT

BACKGROUND OF THE INVENTION

This invention relates to an initializing circuit arrangement for a counter circuit, more particularly an initializing circuit arrangement for a counter circuit in which count correction terminals are also used for initialization.

Digital counters utilized in a digital time piece, for example, for displaying seconds, minutes, hours, dates or week days generally display a random count when a power source is connected so that it is necessary to initialize the counters at such time.

Correction of the count is also necessary when the user wishes to match the displayed time with a correct time.

Conventionally, initialization and correction of the count of a counter have been made with a circuit shown in FIG. 1 which includes input terminals 1 and 1' for applying a source voltage and connected to terminals $V_{DD}$ and $V_{SS}$ of an integrated circuit 2 of a digital time piece. As the integrated circuit 2 may be used C-MOS IC type μPD848C manufactured and sold by Nippon Electric Co., Tokyo Japan, and external circuits are connected to terminals labelled with terminal numbers as shown on the integrated circuit 2. The integrated circuit 2 comprises a crystal oscillation circuit connected to a crystal oscillator 3, a frequency divider for dividing the output frequency of the crystal oscillation circuit, a plurality of counters which count the number of the output signals of the frequency divider for respectively producing pulses at each one minute, ten minutes and one hour, a correction circuit for correcting the counts of these counters, a circuit for initializing the counters to make them have predetermined initial values when a pulse is applied to an initializing terminal I, and a decoder for converting the counts into decimal values supplied to display elements.

There are also provided normal open switches $SW_H$ and $SW_M$ which when closed applies high level signals to terminals H and M for correcting an hour counter which produces a pulse at an interval of one hour, and a minute counter which produces a pulse at each one minute, the hour counter and minute counter being included in the plurality of digital counters described above.

With the prior art circuit, when a source switch SW1 is closed to apply the voltage of a source E to the counters for the purpose of initially setting the counts of respective digital counters in the integrated circuit 2, a pulse produced by the initial charging current supplied to a capacitor C1 from the source E is applied to the initializing terminal I.

For this reason, the prior art circuit requires a terminal (or pin) I for use only for initialization for the counters in the integrated circuit 2. Such a terminal can not be used for other purposes thus limiting the design of the integrated circuit which must be designed such that it can be applied for wide applications with a limited number of terminals.

SUMMARY OF THE INVENTION

Accordingly, it is an object of this invention to provide an initializing circuit arrangement for a counter circuit that can eliminate limitations as described above and permits initialization by using count correction terminals.

Another object of this invention is to provide an initializing circuit arrangement for a plurality of counters which are fabricated as an integrated circuit and can eliminate a terminal exclusively used for initialization, whereby when such a terminal is provided, it can be used for other purposes.

Still another object of this invention is to provide a novel initializing circuit arrangement for use with a plurality of digital counters which can automatically initialize these counters to predetermined counts by simultaneously applying pulses to the correction terminals for the counters, while separately applying correcting pulse to the respective correction terminals.

According to this invention, these and further objects can be accomplished by an initializing circuit arrangement for a counter circuit comprising a power circuit; a plurality of counters each initialized to a predetermined count when it is connected to the power source, each counter normally counting the number of external signals; independent correction terminals adapted to independently correct the counters to which at least two of the plurality of counters are connected for correction of their count; an initializing circuit connected between initializing terminals of the counters and the correction terminals; and an initializing signal generator connected between the initializing circuit and the power source.

DESCRIPTION OF THE PREFERRED EMBODIMENTS

Figure 1:
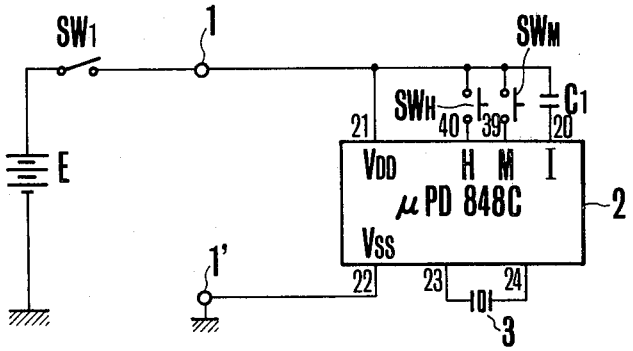
FIG.1 (PRIOR ART)
FIG. 1 is a connection diagram showing one example of the prior art initializing circuit arrangement.
Figure 2:
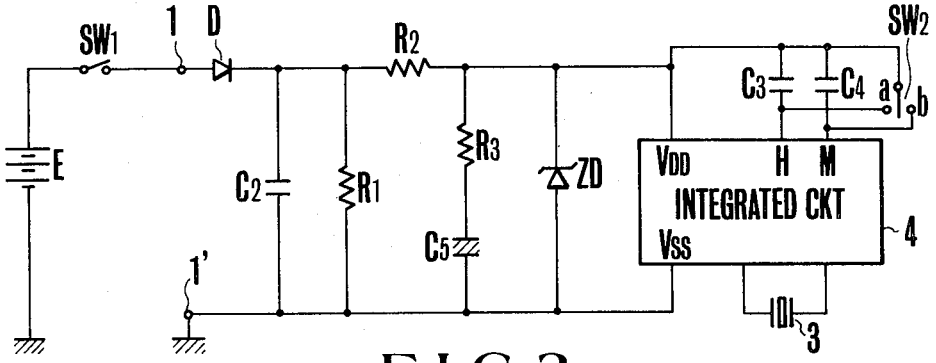
FIG. 2 is a connection diagram showing one example of the initializing circuit arrangement embodying the invention.

In a preferred embodiment of the initializing circuit arrangement shown in FIG. 2, circuit components identical to those shown in FIG. 1 are designated by the same reference numerals. An integrated circuit 4 is provided with terminals H and M and is designed such that the counts of the counters contained therein are set or initialized to predetermined initial values when high level signals are applied simultaneously to its terminals H and M. Where a high level signal is applied to only terminal H, the count representative of hour, for example, is corrected whereas when a high level signal is applied only to terminal M, the count representative of minute, for example, is corrected. It is to be noted that the integrated circuit 4 is not provided with a terminal I exclusively used for initialization which has been essential to a prior art digital time piece and a terminal (not shown) corresponding to the initializing terminal I may be provided for other purposes. A normal open time correction transfer switch SW2 is provided. When it is thrown to a stationary contact a, a high level signal from a source E is applied to terminal H to correct the count representative of hour, whereas when it is thrown to the other stationary contact b, the high level signal from the source E is applied to terminal M to correct the count representative of minute. At times other than the time correction, the transfer switch SW2 is maintained at a neutral position shown in the drawing. Between a power line and the terminal H is connected a capacitor C3, and between the power line and the terminal M is connected a capacitor C4. The capacitance of these capacitors is small and of the order of picofarads, especially, several thousand picofarads. The input terminal 1 is connected to the anode electrode of a reverse current preventing diode D with its cathode electrode connected to one terminal of a resistor R2. A noise absorbing capacitor C2 is connected across the juncture between the diode D and the resistor R2 and the grounded input terminal 1', while a resistor R1 for discharging capacitors C3 and C4 is connected in parallel with the capacitor C2. A Zener diode ZD is connected between the source voltage input terminals $V_{DD}$ and $V_{SS}$ of the integrated circuit 4, and a series circuit comprising a capacitor C5 and a charging delay resistor R3 is connected in parallel with the Zener diode ZD.

The resistor R2 passes a predetermined current through the Zener diode ZD for producing a reference voltage of 6 volts, for example. For the purpose of limiting the current flowing through the Zener diode ZD and hence the power consumption, a high resistance value is selected for the resistor R2.

Figure 3:
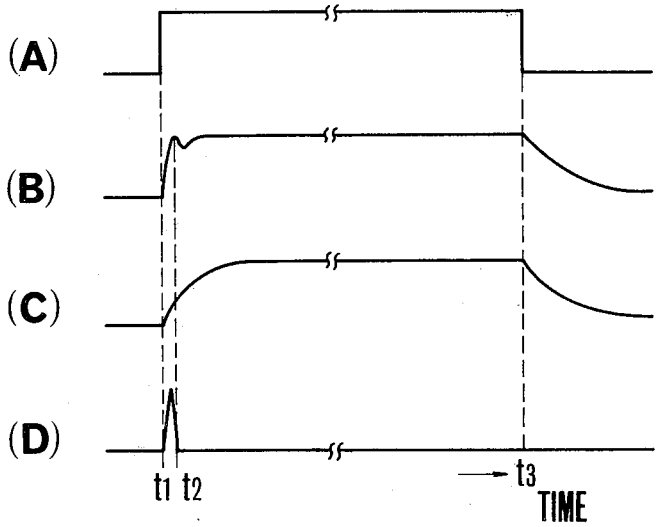
FIGS. 3A through 3D are waveforms useful to explain the operation of the circuit arrangement shown in FIG. 2.

Suppose now that the circuit shown in FIG. 2 is connected to the source E at a time t1, the source voltage as a high level is applied to the input terminal 1 at time t1 as shown in FIG. 3A so as to charge capacitor C5 with a time constant determined by a product of a sum of the resistance values of resistors R2 and R3, and the capacitance value of the capacitor C5. In addition to high resistance value of the resistor R2 for limiting the current flowing through the Zener diode ZD, the value of the resistor R1 is also made to be high for the purpose of decreasing the power consumption of the entire circuit. The capacitor C5 also acts as a back-up capacitor which maintains a predetermined voltage across terminals $V_{DD}$ and $V_{SS}$ even when the source voltage applied to the input terminal 1 is momentarily interrupted for some causes, so that the capacitance of the capacitor C5 is selected to be large. Accordingly, in the absence of the resistor R3, the charging time constant of the capacitor C5 would become small so that the rate of building-up voltage across this capacitor C5 is increased. Accordingly, the amplitude of a positive polarity differentiated pulse obtained by differentiating the capacitor voltage by utilizing capacitors C3 and C4 and pull down resistors to be described later is extremely small so that it is impossible to use this differentiated pulse for initializing the counter.

However, by connecting resistor R3 having a larger resistance value than resistor R2 in series with the capacitor C5, although the rate of rising of the terminal voltage of the capacitor C5 is slow as shown in FIG. 3C, the rate of rising of the voltage across the series circuit comprising the resistor R3 and the capacitor C5 is high as shown in FIG. 3B which is comparable to that shown in FIG. 3A.

Accordingly, the steep rise shown in FIG. 3B is differentiated by a differentiating circuit constituted by pull down resistors R4 and R5 formed in the integrated circuit 4 and capacitors C3 and C4 to simultaneously produce differentiated pulses having a sufficiently large amplitude as shown in FIG. 3D at both junctions between resistors R4 and R5 and waveform shaping circuits S1 and S2 in the form of Schmidt trigger circuits.

Figure 4:
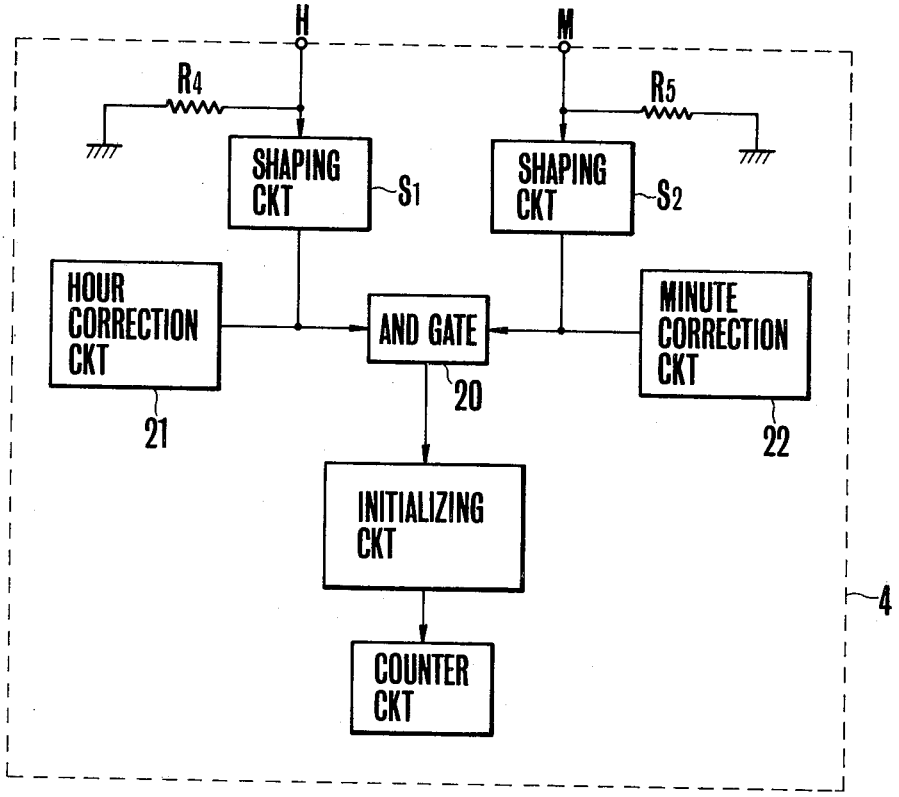
FIG. 4 is a block diagram showing the basic construction of the initializing circuit arrangement embodying the invention.

The positive polarity differentiated pulses formed in a manner described above and applied respectively to the hour correction terminal H and the minute correction terminal M are shaped by the waveform shaping circuits S1 and S2 shown in FIG. 4 where differentiated pulses having a predetermined amplitude are produced for preventing chattering inside of the integrated circuit 4.

The shaped differentiated pulses are then applied to inputs of an AND gate circuit 20 and the output signal of this AND gate circuit is used to operate an initializing circuit independent of count correction circuits, thus setting the counts of the counters in the integrated circuit to predetermined initial values.

As shown in FIG. 4, although the differentiated pulses from the waveform shaping circuits S1 and S2 are also supplied to a hour correction circuit 21 and a minute correction circuit 22, since the initialization has a priority, no hour and minute correction is made. Immediately after the initialization, the differentiated pulses disappear and the counters start their counting operations from initial values. However, when switch SW2 is operated, either one of the hour and minute corrections is made.

Even when the source voltage varies, the voltage applied to the source voltage input terminal $V_{DD}$ of the integrated circuit 4 is maintained at a constant voltage by the Zener diode ZD, so that erroneous operations caused by the variation in the source voltage can be prevented.

When the connection to the source E is interrupted at a time t3 for repairing the integrated circuit 4 or for exchanging the source 4, the input voltage supplied to the terminal $V_{DD}$ falls as shown in FIG. 3A and the voltage across the capacitor C5 also decreases gradually as shown in FIG. 3C. More particularly, as the operation of the oscillating circuit including the quartz oscillator 3 stops due to the decrease of the current, the logic operation of the integrated circuit 4 would be stopped, thus limiting its power consumption. Due to the provision of the discharge resistor R1, the charge of the capacitor C5 is discharged through resistors R3, R2 and R1, and the charges of the capacitors C3 and C4 are discharged through resistors R2 and R1 and through the pull down resistors R4 and R5 contained in the integrated circuit 4 and respectively connected to input terminals H and M. As described above, while the resistor R2 has a high resistance, the capacitors C3 and C4 have small capacitances of the order of picofarads so that these capacitors C3 and C4 can discharge in a short time through the discharge resistor R1.

The reason for providing the discharge resistor R1 is as follows. More particularly, the terminals H and M of the integrated circuit 4 are inherently provided to be used as correction terminals to which pulses for correcting hour and minute are applied through the contacts a and b of the transfer switch SW2 thereby correcting the counts of the counters through the waveform shaping circuits S1 and S2 which are provided for the purpose of preventing noise caused by the chattering of the transfer switch SW2. As a consequence, it is necessary to invert the outputs of the waveform shaping circuits at the time of reconnecting the power source. To this end, the resistor R1 is provided.

More particularly, where resistor R1 is not provided, the capacitors C3 and C4 can not discharge completely with the result that the outputs of the waveform shaping circuits S1 and S2 would not be inverted and retain the same state as that when the source is connected. Consequently, when the source is reconnected to the input terminals 1 and 1' after a relatively short interval following interrupting of the source, the outputs of the waveform shaping circuits would not be inverted so that it is impossible to initialize the counters. By providing the discharge resistor R1 according to this invention, the capacitors C3 and C4 can discharge completely thus inverting the outputs of the waveform shaping circuits S1 and S2. Accordingly, it is possible to initialize the counters even when the power source is reconnected after a short interval following disconnection thereof. In the prior art circuit, such a circuit having a hysteresis characteristic as the Schmidt trigger circuit as described above is not connected to the initializing terminal I so that even with a small discharge of capacitor C1, a differentiated pulse can be obtained at the time of reconnection of the source and hence it is not necessary to provide the discharge resistor R1 as in this invention.

For the reasons described above, the resistor R1 is provided for the purpose of discharging the capacitors. The resistor R1 may be connected across the juncture between the cathode electrode of the Zener diode ZD and the resistor R2 and the ground. Such a connection, however, is disadvantageous because it shares a large proportion of the source voltage. For this reason, it is desirable to connect resistor R1 as shown in FIG. 2.

Figure 2A:
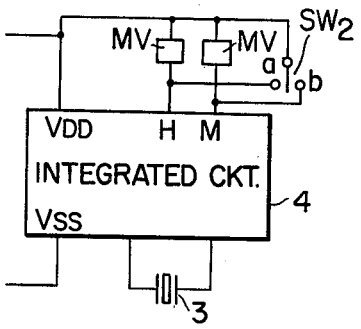
FIG. 2A is a partial circuit like FIG. 2 showing a modification.

Monostable multivibrators MV as shown in FIG. 2A may respectively be substituted for capacitors C3 and C4 shown in FIG. 2 without requiring any additional alternation. In such a case, discharge means like resistor R1 is unnecessary. Moreover, since it is possible to incorporate the monostable multivibrator in the integrated circuit 4 for use in a digital time piece, it is posible to miniaturize advantageously the circuit.

Although in the foregoing embodiments the counters whose initial values are set are used for a time piece which produce counts for displaying hours and minutes, it should be understood that the invention is not limited to such a specific application. The invention is applicable to any digital counter circuits so long as they have a plurality of correction terminals that can independently correct at least two counters by external signals.

Furthermore, diodes may be substituted for capacitors C3 and C4 provided for the purpose of generating initializing differentiated pulses, and a single capacitor may be connected between the diodes and the cathode electrode of the Zener diode ZD.

Since the purpose of the initializing circuit arrangement of this invention is to set the counters to predetermined initial counts, the capacitor C5 shown in FIG. 2 is not always necessary so that resistor R3 is not necessary which should be provided only when the capacitor C5 is used.

Figure 5:
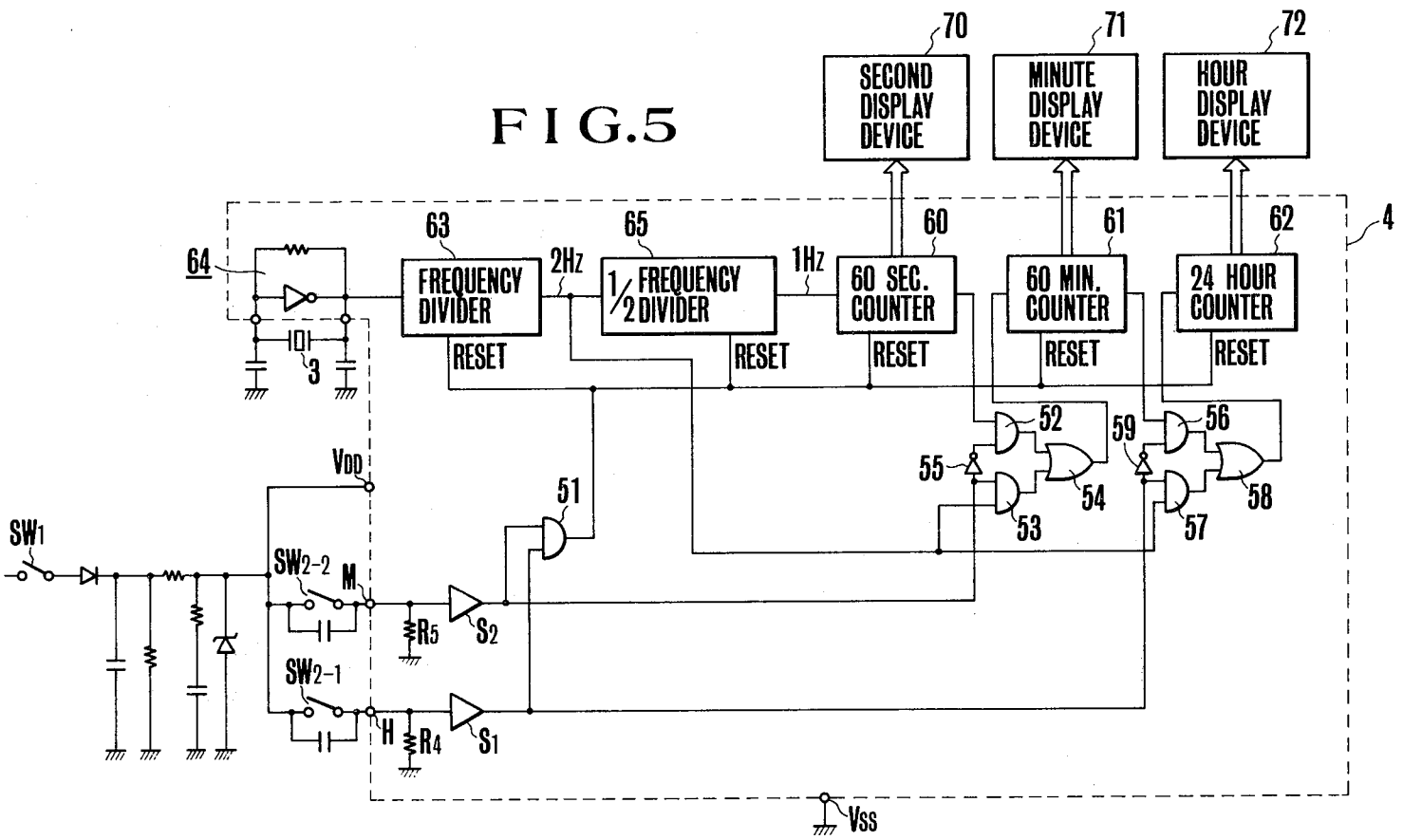
FIG. 5 is a block diagram showing an initializing circuit arrangement of this invention applied to time display counters.

FIG. 5 is a block diagram showing one example of a C-MOSIC constructed according to the teaching of this invention and utilized in a digital time piece. In this embodiment, the counter circuit comprises a 60-second counter 60, a 60-minute counter 61 and a 24-hour counter 62 adapted to display seconds, minutes and hours, respectively. For the sake or simplicity an initializing terminal and a reset terminal of the counters are combined, and the initialization is made by applying a high level signal to the reset terminals of respective counters so as to set the count of the 60-second counter 60 to zero, the count of the 60-minute counter 61 to zero and the count of the 24-hour counter 62 to 1. Accordingly, as a result of the initialization 1 hour, 00 minute, 00 second would be displayed.

In FIG. 5, the integrated circuit 4 comprises a pull down resistor R4 with one end connected to a hour correction terminal H and the other end grounded, a pull down resistor R5 with one end connected to a minute correction terminal M and the other end grounded, a Schmidt circuit S1 with its input terminal connected to the junction between the resistor R4 and the terminal H, and another Schmidt circuit S2 with its input terminal connected to the junction between the resistor R5 and the terminal M. The output of the Schmidt circuit S1 is supplied to one input of an AND gate circuit 51 while the output of the Schmidt circuit S2 is supplied to the other input of the AND gate circuit 51. The output of this AND gate circuit is applied to the reset terminals of the 60-second counter 60, 60-minute counter 61 and 24-hour counter 62 and also to the reset terminal of a first frequency divider 63.

An oscillation circuit 64 comprising an external quartz oscillator 3 is constructed to oscillate at a frequency of 42 MHz, for example, and the first frequency divider 63 supplied with the ouput of the oscillation circuit 63 produces an output of 2 Hz, which is further divided into 1 Hz by a second or ½ frequency divider 65. The 1 Hz output of the ½ frequency divider 65 is counted by the 60-second counter 60 at a rate of one count per second, and the resulting count is displayed by a second display device 70.

The output of the Schmidt circuit S2 is supplied to one input of an AND gate circuit 53 and an inverter 55, the output thereof being applied to one input of an AND gate circuit 52 with the other input connected to the output of the 60-second counter 60. The other input of the AND gate circuit 53 is connected to receive the output of the first frequency divider 63 thus receiving its 2 Hz output signal. The outputs of the AND gate circuits 52 and 53 are applied to the input of the 60-minute counter 61, via an OR gate circuit 54. In the same manner, the output of the Schmidt circuit S1 is applied to one input of an AND gate circuit 57 and an inverter 59. The output of the inverter 59 is applied to one input of an AND gate circuit 56 with the other input connected to the output of the 60-minute counter 61. The other input of the AND gate circuit 57 is supplied with 2 H output signal of the first frequency divider 63. The outputs of the AND gate circuits 56 and 57 are supplied to the input of the 24-hour counter 62 via an OR gate circuit 58.

Although not shown, the terminals $V_{dd}$ and $V_{ss}$ are connected to supply power to various component elements of the integrated circuit 4 and to ground them.

In operation, when the source switch SW1 is closed, high level intializing differentiated pulses are generated simultaneously at terminals H and M which are supplied to the AND gate circuit 51 via the Schmidt circuits S1 and S2 so that the output of this AND gate circuit becomes the high level thereby setting the initial count of the 60-second counter 60 to zero, that of the 60-minute counter 61 to zero and that of the 24-hour counter 62 to 1 to display one hour, 00 minute, 00 second. The high level output of the AND gate circuit 51 is also used to reset the first frequency divider, so that unless the hour correction switch $SW_{2-1}$ or the minute correction switch $SW_{2-2}$ is operated, the time piece would start from one hour, 00 minute, 00 second. At one hour, 00 minute and 60 seconds, the output of the 60-second counter 60 becomes the high level and this high level signal is applied to the other input of the AND gate circuit 52. Since at this time the initializing differentiated pulses are not present, the output of the Schmidt circuit S2 is at a low level and inverted by the inverter 55 to become the high level. As a consequence, the AND gate circuit 52 is enabled and its high level output is supplied to the 60-minute counter 61 via the OR gate circuit 54. Thus, a carry from seconds to minutes is performed. In the same manner, at one hour, 60 minutes, 00 second a carry is effected from minutes to hours by the high level output of the 60-minute counter 61. At this time, one input of each AND gate circuits 53 and 57 is at the low level, so that application of the 2 Hz signal to their other inputs does not enable them.

Then when the minute correction switch $SW_{2-2}$ is closed, one input to the AND gate circuit 52 is at the low level so that the carry from the 60-second counter 60 to the 60-minutes counter 61 does not occur. However, since one input to the AND gate circuit 53 is at the high level, it is enabled each time the 2 Hz signal is applied to its other input to apply the 2 Hz signal to the 60-minute counter 61 via the OR gate circuit 54, thereby correcting the minute display at an interval corresponding to the 2 Hz, that is, 0.5 sec. Obviously, when the hour correction switch $SW_{2-1}$ is closed, the hour displayed is corrected in the same manner. Usually, since the switches $SW_{2-1}$ and $SW_{2-2}$ are not operated simultaneously, the AND gate circuit 51 utilized for initilization would not be enabled.

A described above, according to the initializing circuit arrangement for a counter circuit embodying the invention, connection of a source automatically initializes the count of the counter circuit to a predetermined initial value, thus eliminating a terminal exclusively used for initialization from the counter circuit. Accordingly, where the counter circuit is fabricated as an integrated circuit, it is possible to eliminate such a terminal or pin, or when such pin is provided, it can be used for another purpose thus widening the field of application of the counting circuit. Moreover, as the counter circuit is reconnected to the source, it is possible to automatically initialize the count of the counter circuit to a predetermined initial value. According to a preferred embodiment, a Zener diode is utilized to form a reference voltage and a resistor is used to limit the current flowing through the Zener diode so that it is possible to decrease the power consumption of the circuit.

What is claimed is:

1. An initializing circuit arrangement for a counter circuit comprising:

a power source providing operating voltage between ground and supply terminals switch-connected to an input line;

a plurality of counters each including an initializing terminal for setting its counter to a predetermined count in response to an initializing signal, each counter normally counting the number of external signals;

independent correction terminals for at least two of the plurality of counters each correction terminal connected to means for correcting its counter in response to a correction signal on its correction terminal;

an initializing circuit connected between the initializing terminal of each of the counters and said correction terminals; and an initializing signal generator means connected between said initializing circuit and said input line for generating said initializing signal upon connection to said power source.

2. The initializing circuit arrangement according to claim 1 wherein said initializing signal generator comprises a first capacitor connected between said input line from said power source and one of said correction terminals, a second capacitor connected between said input line and the other of said correction terminals, a first resistor connected between said one correction terminal and ground, a second resistor connected between the other correction terminal and the ground, and wherein said initializing circuit comprises an AND gate circuit with one input connected to said one correction terminal, and the other input connected to said other correction terminal, and an output connected to the initializing terminals of said counters.

3. The initializing circuit arrangement according to claim 2 wherein a third resistor is connected across said input line and the ground for discharging the capacitors of said initializing signal generator.

4. The initializing circuit arrangement according to claim 2 which further comprises a transfer switch which transfers electric connections between said input line and said correction terminals, said transfer switch being connected for selective connection in parallel with either said first or said second capacitors.

5. The initializing circuit arrangement according to claim 2 which further comprises a resistor and a capacitor which are connected in series across said input line from said power source and ground so as to produce a steep rise voltage when the power source is connected to the circuit.

6. The initializing circuit arrangement according to claim 1 wherein said initializing signal generator comprises a first monostable multivibrator connected between said input line from said power source and one of said correction terminals, a second monostable multivibrator connected between said input line and the other of said correction terminals, a first resistor connected between said one correction terminal and ground, a second resistor connected between the other correction terminal and the ground, and wherein said initializing circuit comprises an AND gate circuit with one input connected to said one correction terminal, the other input connected to said other correction terminal, and an output connected to said initializing terminals of said counters.

7. The initializing circuit arrangement according to claim 6 which further comprises a transfer switch which transfers electric connections between said input line and said correction terminals, said transfer switch being connected for selective connection in parallel with said first or said second monostable multivibrators.

* * * * *